US007695214B2

(12) United States Patent
Mailand

(10) Patent No.: US 7,695,214 B2
(45) Date of Patent: Apr. 13, 2010

(54) ASPHALT PAVEMENT REMOVER

(76) Inventor: Robert Mailand, 102 S. Ocean Ave., Bayport, NY (US) 11705

( * ) Notice: Subject to any disclaimer, the term of this patent is extended or adjusted under 35 U.S.C. 154(b) by 0 days.

(21) Appl. No.: 11/800,549

(22) Filed: May 7, 2007

(65) Prior Publication Data

US 2008/0279628 A1 Nov. 13, 2008

(51) Int. Cl.
*E01C 23/12* (2006.01)

(52) U.S. Cl. ..... 404/90; 299/36.1

(58) Field of Classification Search ..... 404/90, 404/93, 94; 37/301, 302, 303, 404; 299/36.1, 299/37.1–38.1; 172/699
See application file for complete search history.

(56) References Cited

U.S. PATENT DOCUMENTS

| | | | | | |
|---|---|---|---|---|---|
| 2,081,192 | A | * | 5/1937 | Allin et. al. | 37/301 |
| 2,679,701 | A | * | 6/1954 | Busque | 37/301 |
| 2,776,504 | A | * | 1/1957 | Green | 37/302 |
| 2,806,682 | A | * | 9/1957 | Ankersheil | 37/301 |
| 2,949,945 | A | * | 8/1960 | Billings | 144/34.1 |
| 2,984,029 | A | * | 5/1961 | Pederson | 172/777 |
| 3,033,253 | A | * | 5/1962 | Purdy | 144/34.1 |
| 3,103,076 | A | * | 9/1963 | Schultz | 37/303 |
| 3,243,904 | A | * | 4/1966 | Perry | 37/403 |
| 3,268,012 | A | * | 8/1966 | Ratkowski | 172/700 |
| 3,542,435 | A | * | 11/1970 | Herrmann | 299/36.1 |
| 3,592,509 | A | | 7/1971 | Soderlund | |
| 3,743,358 | A | | 7/1973 | Guest | |
| 3,773,386 | A | | 11/1973 | Soderlund | |
| 3,845,796 | A | * | 11/1974 | Moore | 144/1.1 |
| 3,885,833 | A | * | 5/1975 | Lemieux | 299/36.1 |
| 4,043,601 | A | * | 8/1977 | Schiller | 299/36.1 |
| 4,164,247 | A | * | 8/1979 | Wolf | 144/34.6 |
| 4,641,439 | A | * | 2/1987 | Shirek | 37/303 |
| 4,659,250 | A | | 4/1987 | Nelson | |
| 4,682,638 | A | * | 7/1987 | Becker | 144/24.12 |
| 4,749,048 | A | * | 6/1988 | Kelly | 172/699 |
| 4,903,418 | A | * | 2/1990 | Loudon | 37/301 |
| 5,423,137 | A | * | 6/1995 | Cochran | 37/408 |
| 5,490,340 | A | * | 2/1996 | Muncy | 37/301 |
| 5,495,987 | A | * | 3/1996 | Slaby | 241/27 |
| 5,628,130 | A | * | 5/1997 | Desrochers | 37/444 |
| 5,687,784 | A | * | 11/1997 | Morgan | 144/34.6 |
| 6,146,081 | A | * | 11/2000 | Anderson | 414/685 |
| 6,308,440 | B1 | * | 10/2001 | Mueller | 37/404 |
| 6,408,907 | B1 | * | 6/2002 | Lantz | 144/195.1 |
| 6,443,237 | B1 | | 9/2002 | Myers et al. | |
| 6,763,618 | B1 | * | 7/2004 | Moran | 37/301 |
| 6,776,571 | B2 | * | 8/2004 | Riffle | 414/722 |
| 7,226,268 | B2 | * | 6/2007 | Gustafson et al. | 414/723 |
| D552,133 | S | * | 10/2007 | Babcock et al. | D15/127 |
| 2005/0072345 | A1 | | 4/2005 | Steinlage et al. | |
| 2008/0016725 | A1 | * | 1/2008 | Boehm | 37/302 |
| 2008/0084106 | A1 | * | 4/2008 | Marathe et al. | 299/110 |

* cited by examiner

*Primary Examiner*—Thomas B Will
*Assistant Examiner*—Mai T Nguyen
(74) *Attorney, Agent, or Firm*—Galgano & Associates, PLLC

(57) ABSTRACT

An asphalt pavement remover includes a rectangular backplate for attachment to moving equipment, an L-shaped lifting blade attached to the front of the backplate and a wedge-shaped splitter attached to the L-shaped blade. The L-shaped blade includes an upstanding arm and a lower arm, the latter of which is similar to a fork-lift blade. The wedge-shaped splitter extends in the direction of the lower arm of the L-shaped blade, i.e., away from the upstanding arm. The splitter has a forward wedge-shaped edge which is located rearward of the forward end of the lifting blade.

14 Claims, 5 Drawing Sheets

ASPHALT PAVEMENT REMOVER

BACKGROUND OF THE INVENTION

1. Field of the Invention

This invention relates broadly to an apparatus for cutting up and dislodging asphalt pavement so that it can be removed with minimal disturbance to the subgrade, and, optionally, replaced. More particularly, this invention relates to an attachment for a skid steer, bucket loader, tractor or the like which is then used to cut and dislodge asphalt pavement 2. State of the Art Asphalt is one of the most popular materials for paving roads, driveways, and parking lots. There are many reasons why asphalt pavement may need to be removed and replaced. One reason is to access something buried beneath it such as a cable or a fluid conduit. Another reason is normal maintenance. Over the course of time asphalt pavement deteriorates to the point where it must be removed and replaced.

It has been known for some time to attach an asphalt pavement cutting device to moving equipment such as a tractor, backhoe, or forklift. U.S. Pat. No. 3,885,833 to Lemieux discloses a cutter attachment which is adapted to be installed on the forward edge of a bucket of an earth moving vehicle. The attachment includes an elongated blade support body with a rear horizontal slot for receiving the forward lower edge of the bucket and a forward end or nose. The attachment further includes a pair of generally rectangular and flat, co-planar, vertically extending fins mounted centrally on the cutter body. This attachment is intended for cutting the surface of blacktop. The fins extend upward and downward respectively. However, only the downward extending fin is actually used to cut.

U.S. Pat. No. 4,043,601 to Schiller discloses an asphalt cutter having a flat-sided lifter blade with inner edges and a pair of flat co-planar "keepers" on each side of the blade. The asphalt cutter is attached to a tractor-like machine equipped with an adjustable header, bucket or draw bar.

U.S. Pat. No. 4,749,048 to Kelly discloses a ripper attachment for a skid steer loader having a triangular frame, a mounting plate attached at the base of the triangular frame, and a scarifier receptacle attached at the apex of the triangular frame. A single shank scarifier is fastened to the apex and is oriented downward so that the tooth is drivable into the ground for ripping purposes.

All of the known asphalt pavement cutter attachments have some disadvantages. In general, it would be desirable to provide an attachment for a skid steer, bucket loader or the like which overcomes all of the disadvantages of the prior art devices.

SUMMARY OF THE INVENTION

It is therefore an object of the invention to provide an attachment for a skid steer, bucket loader or the like which cuts asphalt pavement It is another object of the invention to provide an attachment for a skid steer, bucket loader or the like which cuts asphalt pavement while moving in a forward direction.

It is a further object of the invention to provide an attachment for a skid steer, bucket loader or the like which cuts asphalt pavement without impairing the operator's view of what is being cut.

It is also an object of the invention to provide an attachment for a skid steer, bucket loader or the like which cuts asphalt pavement and also rips it up from the ground.

It is an additional object of the invention to provide an attachment for a skid steer, bucket loader or the like which cuts asphalt pavement, rips it up from the ground with minimal disturbance to the subgrade and which has a relatively high flexibility.

In accord with these objects, which will be discussed in detail below, the asphalt pavement remover includes a rectangular backplate for attachment to the moving equipment, an L-shaped lifting blade attached to the front of the backplate and a wedge-shaped splitter attached to the L-shaped blade. The L-shaped blade includes an upstanding arm and a lower arm, the latter of which is similar to a fork-lift blade. The wedge-shaped splitter extends in the direction of the lower arm of the L-shaped blade, i.e., away from the upstanding arm. The splitter has a forward wedge-shaped edge which is located rearward of the forward end of the lifting blade.

The backplate is designed to be fitted to a particular moving machine. A skid steer is preferred because it can provide the best visibility of what is being cut and lifted. The lifting blade is preferably thirty-six to forty-two inches long and is preferably four to five inches wide. The thickness of the lifting blade is preferably varied along its length with the thickest part being where it is joined to the backplate. The preferred thickness is three sixteenths of an inch at the tip and one and one half inches at the back. The lifting blade is preferably made from a relatively flexible carbon steel such as AISI 15B37H steel which has an elastic modulus of 190-210 GPa at 25° C. The flexibility of this steel prevents the lifting blade from breaking or becoming deformed when lifting asphalt pavement.

The wedge shaped splitter is preferably eight to fourteen inches tall and about the same length. The angle of the cutting edge of the wedge-shaped splitter is preferably forty-five degrees and the wedge-shaped splitter, at its widest part, is preferably no wider than the lifting blade. Depending on the moving equipment the lower arm of the L-shaped blade may or may not form a right angle with the backplate. According to the preferred embodiment, the lower arm of the L-shaped blade is horizontal when the hydraulics of the machine are tipped full back.

When in operation, the lower arm of the L-shaped blade is angled down and the machine is moved forward to get the blade underneath the asphalt. Once underneath the asphalt, the blade is straightened and the machine is moved forward so as to cause the splitter to cut the asphalt in a line while the L-shaped blade lifts the asphalt.

Depending on the depth of the asphalt, it may be ripped up by the L-shaped blade before it is cut by the splitter. When the ripped asphalt reaches the wedge-shaped splitter, it is broken up and separated further (much like a log splitter). The lower arm of the L-shaped blade is disposed lower than the back plate so that the broken apart asphalt can pass underneath the plate as the skid steer moves forward.

Additional objects and advantages of the invention will become apparent to those skilled in the art upon reference to the detailed description taken in conjunction with the provided figures.

DETAILED DESCRIPTION

Figure 1:
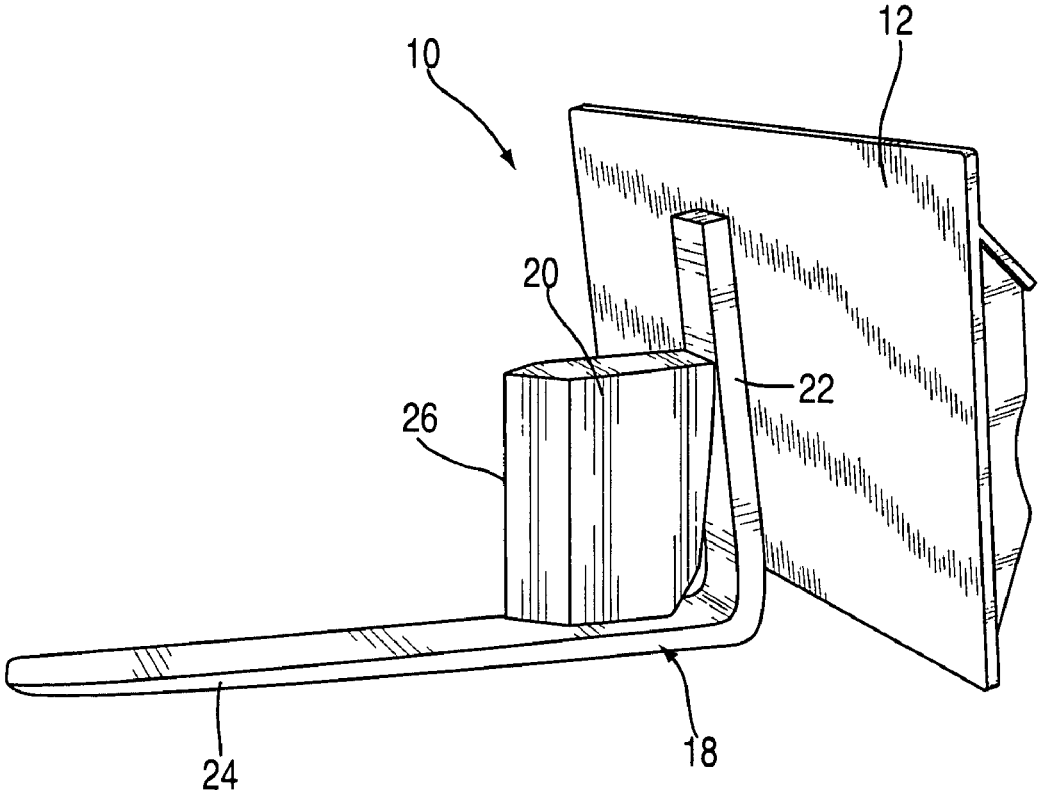
FIG. 1 is a front perspective view of an asphalt pavement remover according to the invention.
Figure 2:
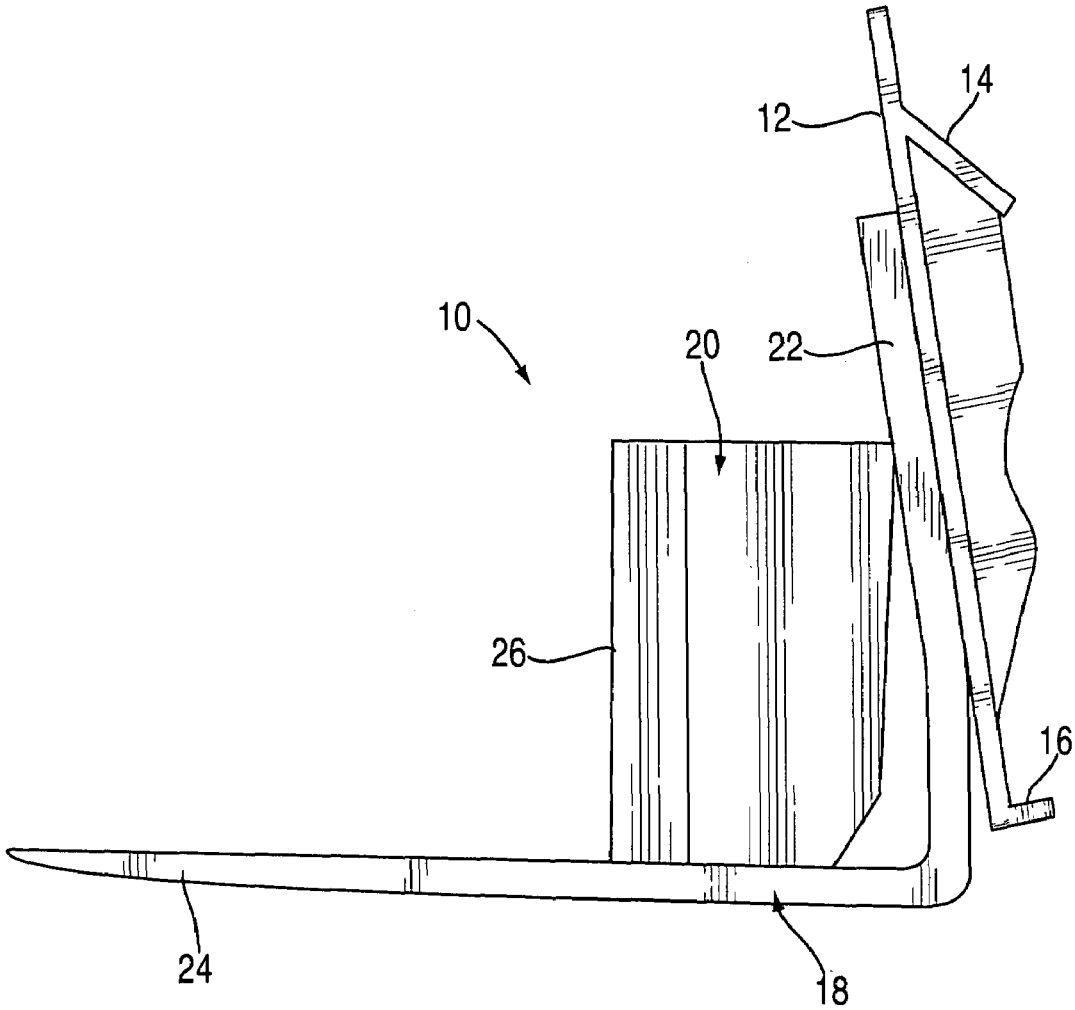
FIG. 2 is a side elevation view of the asphalt pavement remover of FIG. 1.
Figure 3:
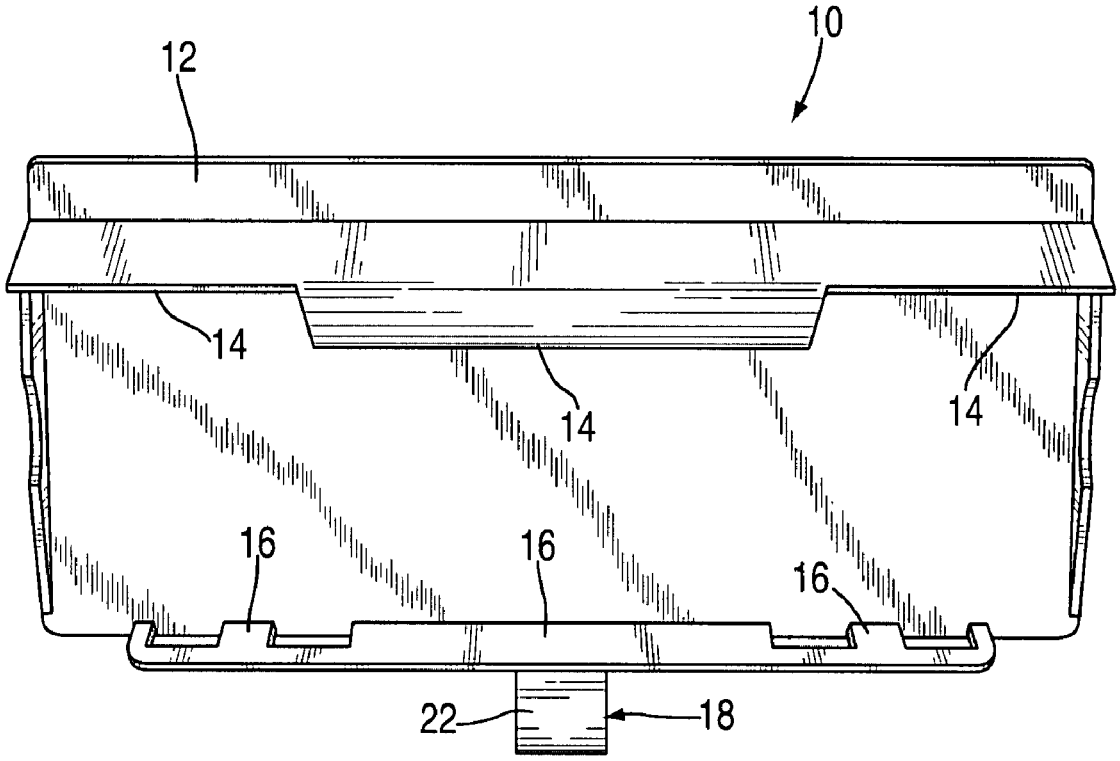
FIG. 3 is a rear elevation view of the asphalt pavement remover of FIG. 1.

Turning now to FIGS. 1-3, the asphalt pavement remover 10 includes a rectangular backplate 12 for attachment to a skid steer, or the like. FIG. 3 shows upper and lower coupling structure 14, 16 which are adapted to couple to a Gehl 7810 skid loader (available from Gehl Company, West Bend, Wis.). Different, conventionally-known, structure might be required for coupling to different model moving equipment.

An L-shaped lifting fork or blade 18 attached to the front of the backplate 12 and a wedge-shaped splitter 20 is attached to the L-shaped lifting blade 18. The one-piece L-shaped blade 18 includes an upstanding arm 22 and a lower arm 24, the latter of which is similar to a fork-lift blade. The wedge-shaped splitter 20 extends in the direction of the lower arm 24 of the L-shaped blade 18, i.e., away from the upstanding arm 22. The splitter has a forward wedge-shaped edge 26 which is located rearward of the forward end of the lower arm 24 of the lifting blade 18.

The lower arm 24 of the lifting blade 18 is preferably thirty-six to forty-two inches long and is preferably four to five inches wide. The thickness of the lifting blade 18 is preferably varied along its length with the thickest part being where it is joined to the backplate. The preferred thickness is three sixteenths of an inch at the tip and one and one half inches at the back. The lifting blade is preferably made from a relatively flexible carbon steel such as AISI 15B37H steel which has an elastic modulus of 190-210 GPa at 25° C. The flexibility of this steel prevents the lifting blade from breaking or becoming deformed when lifting asphalt pavement.

The wedge shaped splitter 20 is preferably eight to fourteen inches tall and about the same length. The angle of the cutting edge 26 of the wedge-shaped splitter is preferably eighty to forty-five degrees and the wedge-shaped splitter, at its widest part, is preferably no wider than the lifting blade 18. Depending on the moving equipment, the lower arm 24 may or may not form a right angle with the backplate 12. According to the preferred embodiment, the lower arm of the L-shaped blade is configured so that it is horizontal when the hydraulics of the machine are tipped full back. Depending on the machine it is attached to, the L-shaped blade may form an angle relative to back plate 12 greater than or less than ninety degrees.

Figure 4:
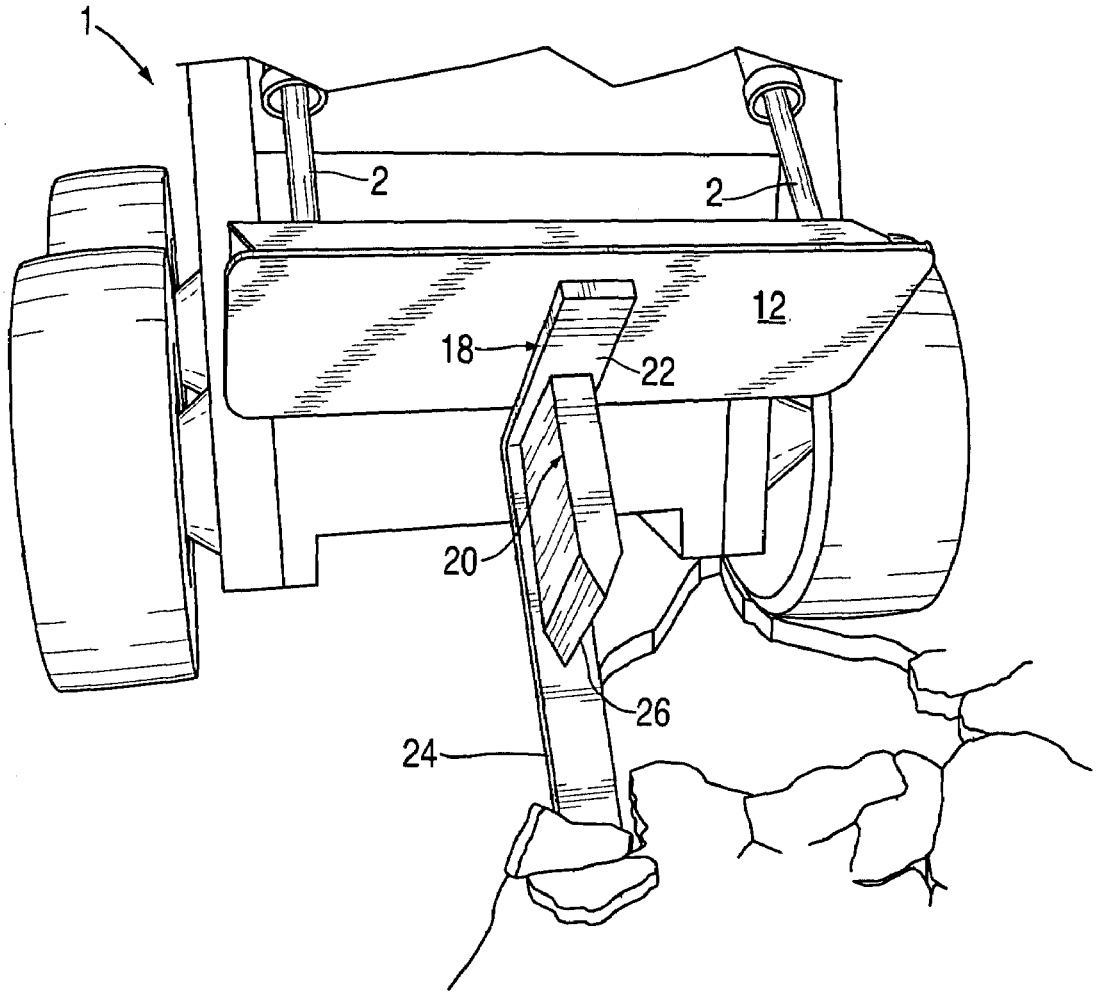
FIG. 4 is a broken perspective view of the asphalt pavement remover of FIG. 1 attached to a skid steer and angled down.
Figure 5:
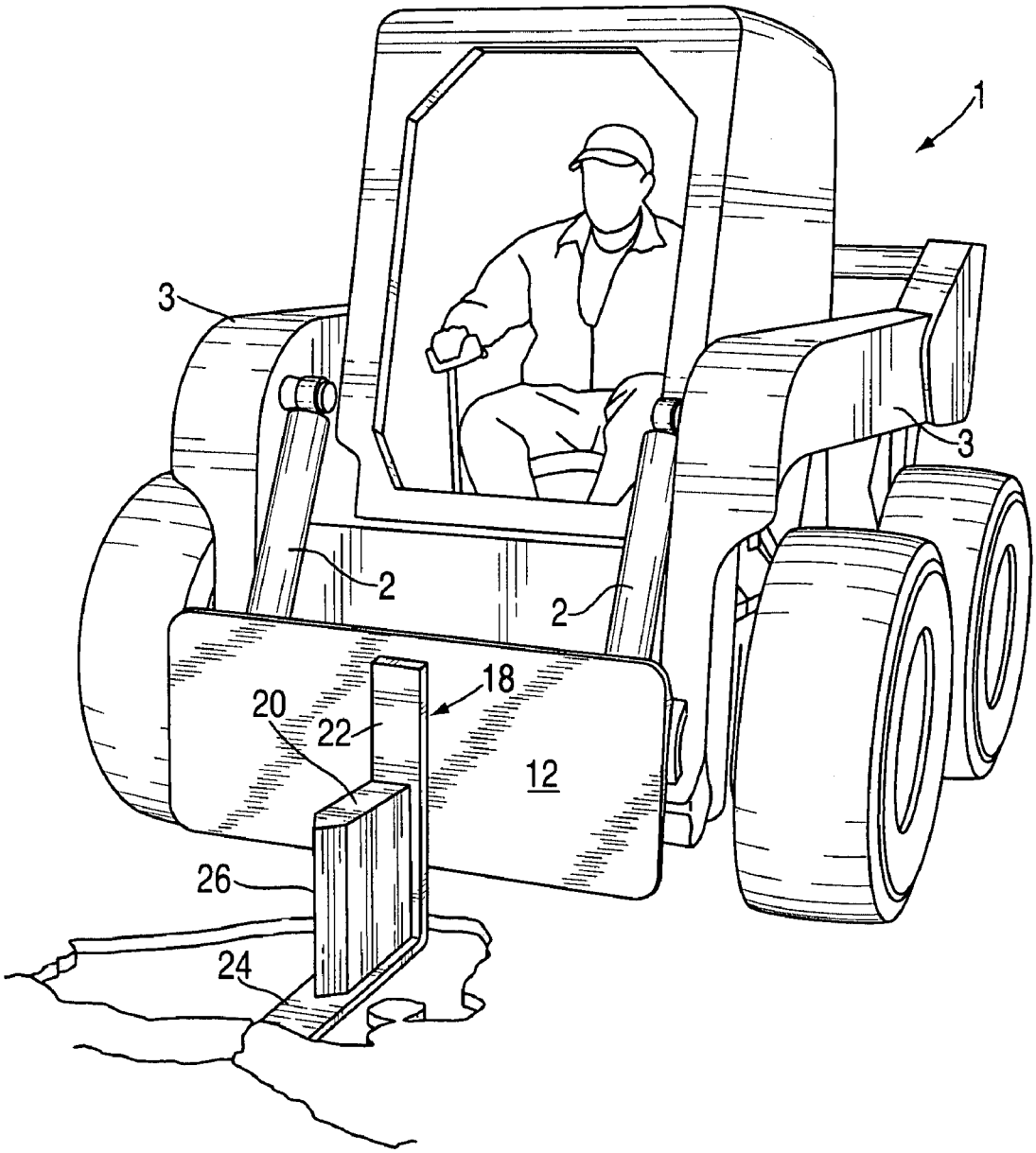
FIG. 5 is a perspective view of the asphalt pavement remover of FIG. 1 attached to a skid steer and angled flat.

As mentioned above, the backplate is designed to be fitted to a particular moving machine. A skid steer (skid loader) is preferred because it can provide the best visibility of what is being cut and lifted. FIGS. 4 and 5 show the invention coupled to the articulated and hydraulically-operated arms 2 of a Gehl 7810 skid loader 1. The articulating arms are capable of tilting forward and rearward. Lifting is done from the rear of the skid loader via pivot arms 3.

When in operation, the lower arm 24 of the L-shaped blade is angled down and the machine is moved forward to get the blade underneath the asphalt as shown in FIG. 4. Once underneath the asphalt, the blade is straightened as shown in FIG. 5 and the machine is moved forward so as to cause the splitter to cut the asphalt in a line while the L-shaped blade lifts the asphalt.

Depending on the depth of the asphalt, it may be ripped up by the L-shaped blade before it is cut by the splitter. When the ripped asphalt reaches the wedge-shaped splitter, it is broken up and separated further (much like a log splitter). As seen best in FIGS. 1, 3, and 5 the lower arm 24 of the L-shaped blade 18 is disposed lower than the bottom edge of the back plate 12 so that the broken apart asphalt can pass underneath the back plate 12 as the skid steer moves forward. Preferably, the lower arm 24 of the L-shaped blade is approximately seven inches lower than the bottom edge of the back plate 12.

There have been described and illustrated herein an asphalt pavement remover. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. An asphalt pavement remover for use with a moving machine, the moving machine having an articulating element capable of tilting forward and rearward and lifting, said asphalt pavement remover comprising:

a backplate adapted to be attached to the articulating element;

a single L-shaped lifting blade attached to and centrally disposed on the backplate and extending outward from the backplate, said L-shaped lifting blade including a generally planar upstanding arm and a generally planar, elongated lower arm having a forward end wherein the upstanding arm and the lower arm define a right angle; and a wedge-shaped splitter attached to and on top of said lower arm of said L-shaped lifting blade, the wedge-shaped splitter having a width, wherein the width at its widest part is no wider than a width of said L-shaped lifting blade, wherein said wedge-shaped splitter has a forward end extending in the same direction of said lower arm of said L-shaped lifting blade away from said upstanding arm, said wedge-shaped splitter having a length which is less than half a length of the lower arm of the L-shaped lifting blade such that said forward end of said wedge-shaped splitter is located rearwardly of said forward end of said lower arm of the L-shaped lifting blade and wherein said forward end of said wedge-shaped splitter is wedge-shaped and has two opposed, generally vertical faces which taper and meet to form a leading edge.

2. An asphalt pavement remover according to claim 1, wherein:

said two opposed, generally vertical faces of said wedge-shaped forward end form an angle of 45° to 80°.

3. An asphalt pavement remover according to claim 1, wherein:

said lifting blade is thirty-six to forty-two inches long.

4. An asphalt pavement remover according to claim 3, wherein:

said lifting blade is four to five inches wide.

5. An asphalt pavement remover according to claim 4, wherein:

said lower arm of said L-shaped lifting blade has a free end which defines said forward end of said lifting blade and a rearward end, and wherein said lower arm has a thickness that varies from three sixteenths of an inch at said forward end to one and one half inches at said rearward end.

6. An asphalt pavement remover according to claim 1, wherein:

said lifting blade is made from carbon steel.

7. An asphalt pavement remover according to claim 1, wherein:

said lifting blade is made from steel.

8. An asphalt pavement remover according to claim 1, wherein:

said lifting blade is made from steel which has an elastic modulus of 190-210 GPa at 25° C.

9. An asphalt pavement remover according to claim 1, wherein:

said wedge-shaped splitter is eight to fourteen inches tall.

10. An asphalt pavement remover according to claim 1, wherein:

said backplate is rectangular.

11. An asphalt pavement remover according to claim 1, wherein:

said backplate has a bottom edge and the lower arm of the L-shaped lifting blade is approximately seven inches lower than the bottom edge of the backplate.

12. An asphalt pavement remover according to claim 1, wherein:

said backplate has a bottom edge and said lower arm of said L-shaped lifting blade is disposed lower than said bottom edge of said backplate.

13. An asphalt pavement remover according to claim 1, wherein:

the width of said L-shaped lifting blade is substantially equivalent to the width of said wedge-shaped splitter.

14. An asphalt pavement remover according to claim 1, wherein:

said lower arm of the L-shaped lifting blade is in the shape of a fork-lift blade.

* * * * *